US005960894A

United States Patent [19]

Lilly et al.

[11] Patent Number: 5,960,894

[45] Date of Patent: Oct. 5, 1999

[54] EXPENDABLE TUBING CONVEYED PERFORATOR

[75] Inventors: Terry G. Lilly; Leslie E. Noel; Edwin G. Steiner, all of York; William Kamper, Red Lion, all of Pa.

[73] Assignee: Primex Technologies, Inc., St. Petersburg, Fla.

[21] Appl. No.: 09/039,171

[22] Filed: Mar. 13, 1998

[51] Int. Cl.[6] ..... E21B 43/117

[52] U.S. Cl. ..... 175/4.6; 166/55.1; 166/297

[58] Field of Search ..... 175/4.6; 166/55.1, 166/297

[56] References Cited

U.S. PATENT DOCUMENTS

| | | | |
|---|---|---|---|
| 2,749,840 | 6/1956 | Babcock | 175/4.6 |
| 2,968,243 | 1/1961 | Turechek | 175/4.6 |
| 3,211,093 | 10/1965 | McCullough et al. | 175/4.6 |
| 4,253,523 | 3/1981 | Ibsen | 166/299 |
| 4,467,878 | 8/1984 | Ibsen | 175/4.6 |
| 4,537,255 | 8/1985 | Regalbutto et al. | 166/297 |
| 4,633,951 | 1/1987 | Hill et al. | 166/308 |
| 4,683,943 | 8/1987 | Hill et al. | 166/63 |
| 4,718,493 | 1/1988 | Hill et al. | 166/308 |
| 4,823,875 | 4/1989 | Hill et al. | 166/280 |
| 4,905,759 | 3/1990 | Wesson et al. | 166/55 |
| 4,958,569 | 9/1990 | Mandigo | 102/476 |
| 5,044,437 | 9/1991 | Wittrisch | 166/250 |
| 5,098,487 | 3/1992 | Brauer et al. | 148/432 |
| 5,148,868 | 9/1992 | Christian | 166/297 |
| 5,303,772 | 4/1994 | George et al. | 166/208 |
| 5,318,126 | 6/1994 | Edwards et al. | 166/297 |
| 5,327,974 | 7/1994 | Donovan et al. | 166/297 |
| 5,366,014 | 11/1994 | George | 166/297 |
| 5,398,760 | 3/1995 | George et al. | 166/297 |
| 5,490,563 | 2/1996 | Wesson et al. | 166/297 |
| 5,509,481 | 4/1996 | Huber et al. | 166/297 |
| 5,598,891 | 2/1997 | Snider et al. | 166/308 |
| 5,829,538 | 11/1998 | Wesson et al. | 175/4.6 |

*Primary Examiner*—Hoang C. Dang
*Attorney, Agent, or Firm*—Todd E. Garabedian; Wiggin & Dana

[57] ABSTRACT

The invention is directed to an expendable tubing conveyed perforator, comprising (a) an outer tube made from a material having high strength and low impact resistance; and (b) an inner structure positioned within the outer tube for holding one or more explosive charges, the inner structure made from a combustible material. The invention is also directed to a method of perforating a well casing using the expendable tubing conveyed perforator system.

22 Claims, 4 Drawing Sheets

EXPENDABLE TUBING CONVEYED PERFORATOR

BACKGROUND OF THE INVENTION

1. Field of the Invention

The invention relates generally to tubing conveyed perforator systems for perforating well casings, and more particularly to an expendable tubing conveyed perforator made from frangible and consumable materials. The invention also relates to methods of perforating well casings using an expendable tubing conveyed perforator made from frangible and consumable materials.

2. Description of the Art

Drilling of wells generally, and oil wells in particular, follows protocols that are well known in the industry. Conventionally, a hole is drilled into the earth where a reserve of useful fluid material, such as oil, gas, or water has been identified. A steel casing is next installed to line the hole and prevent the earth from filling the hole. The casing is then lined with a tube so that the material to be extracted may be conveyed to the surface. However, in order for the fluid material to enter the hole casing and be removed, it is necessary to perforate the casing.

Conventionally, perforation of the well casing is performed using a device termed a "tubing conveyed perforator" (TCP). The basic TCP unit consists generally of a 6–30 foot metal tube with a series of explosive charges placed along the centerline axis and pointing outward radially. The TCP is often made from a series of perforator unit segments that are connected together to form a desired length, often conforming to the width of the adjacent fluid reservoir. The TCP is lowered into the casing to the desired depth, and the charges are fired. The explosive force of the charges perforates the metal tube, the well casing, and the rock formation to produce holes in the rock formation that surrounds the fluid reserve. After firing, any remaining portion of the TCP is pulled out of the casing, and, if intact, can be reloaded with charges and reused. The fluids from the underground reserve flow or are forced through the newly formed holes in the casing, and into the extraction tube where they are collected and extracted.

However, the above method of perforating the well casing has several disadvantages. In many drilling situations, the post-fired metal tube that held the shaped charges cannot be removed from the hole without destroying the well. In these situations, expendable perforators are employed to fire the charges. Following firing, the expendable perforating system is dropped to the bottom of the drilled hole that extends below the targeted formation (known as the "rathole" portion of the well). However, formation of the "rathole" portion of the well requires additional drilling to depths as much as 2,000 feet beyond the target area so that the expended perforator can be accommodated. This extra drilling results in considerable additional time and drilling costs.

In addition, the conventional metal tubing used for the TCP generally fragments into large pieces of debris upon firing of the charges. These large pieces of metal debris often cause problems in fluid extraction, such as jamming of equipment, preventing tube removal, inhibiting fluid flow, contaminating the fluid, or clogging pumps or tubing used to extract the fluid.

One solution to these problems is described in U.S. Pat. No. 4,905,759 to Wesson et al., herein incorporated by reference in its entirety. The device described in this U.S. Patent utilizes spacer tubes between the TCP units that telescopically collapse lengthwise after firing. While this approach can reduce the required depth of the "rathole" and reduce drilling efforts, a significant portion of the rathole must still be drilled below the target depth. Moreover, debris from the expended TCP units are still capable of clogging oil pumping equipment and tubing, or jamming the device in the well casing thereby inhibiting oil flow. What is needed in the art is a tubing conveyed perforator that does not require substantial additional drilling and does not have the potential to clog oil extraction equipment with debris. The present invention is believed to be an answer to that need.

SUMMARY OF THE INVENTION

In one aspect, the present invention is directed to an expendable tubing conveyed perforator, comprising an outer tube made from a material having high strength and low impact resistance; and an inner structure positioned within the outer tube for holding one or more explosive charges, the inner structure made from a combustible material.

In another aspect, the present invention is directed to an expendable tubing conveyed perforator, comprising (a) an outer tube made from a material having high strength and low impact resistance; (b) an inner structure positioned within the outer tube for holding one or more explosive charges, the inner structure made from a combustible material; and (c) a disintegration-enhancing tube positioned between the outer tube and the inner structure; wherein substantially all of the outer tube is fragmented upon detonation of the one or more explosive charges, and wherein substantially all of the inner structure is combustibly consumed upon detonation of the one or more explosive charges, and wherein substantially all of the disintegration-enhancing tube is combustibly consumed upon detonation of the one or more explosive charges.

In another aspect, the present invention is directed to a method of perforating a well casing, comprising the step of detonating an expendable tubing conveyed perforator inserted into the well casing, the tubing conveyed perforator comprising: an outer tube made from a material having high strength and low impact resistance; and an inner structure positioned within the outer tube and holding one or more explosive charges, the inner structure made from a combustible material; and wherein substantially all of the outer tube is fragmented upon detonation of the one or more explosive charges, and substantially all of the inner structure is combustibly consumed upon detonation of the one or more explosive charges.

These and other aspect will be described in more detail in the following detailed description of the invention.

BRIEF DESCRIPTION OF THE DRAWINGS

The invention will be more fully understood from the following detailed description taken in conjunction with the accompanying drawings in which.

DETAILED DESCRIPTION OF THE INVENTION

As described above, the invention is an expendable tubing conveyed perforator (TCP) comprising an outer tube made from a material having high strength and low impact resistance; and an inner structure made from a combustible material that holds one or more explosive charges. The present invention overcomes problems with prior art TCPs in that substantially all of the outer tube is fragmented upon detonation, and the inner structure is combustibly consumed upon detonation. Thus, the expendable TCP of the present invention does not require that an extended rathole be prepared, nor depressurization of the well system for perforator removal. In addition, due to the highly frangible nature of the materials used to make the outer tube of the TCP of the present invention, the pieces produced after detonation of the expendable TCP are less likely to inhibit fluid flow or clog the extraction equipment.

Figure 1:
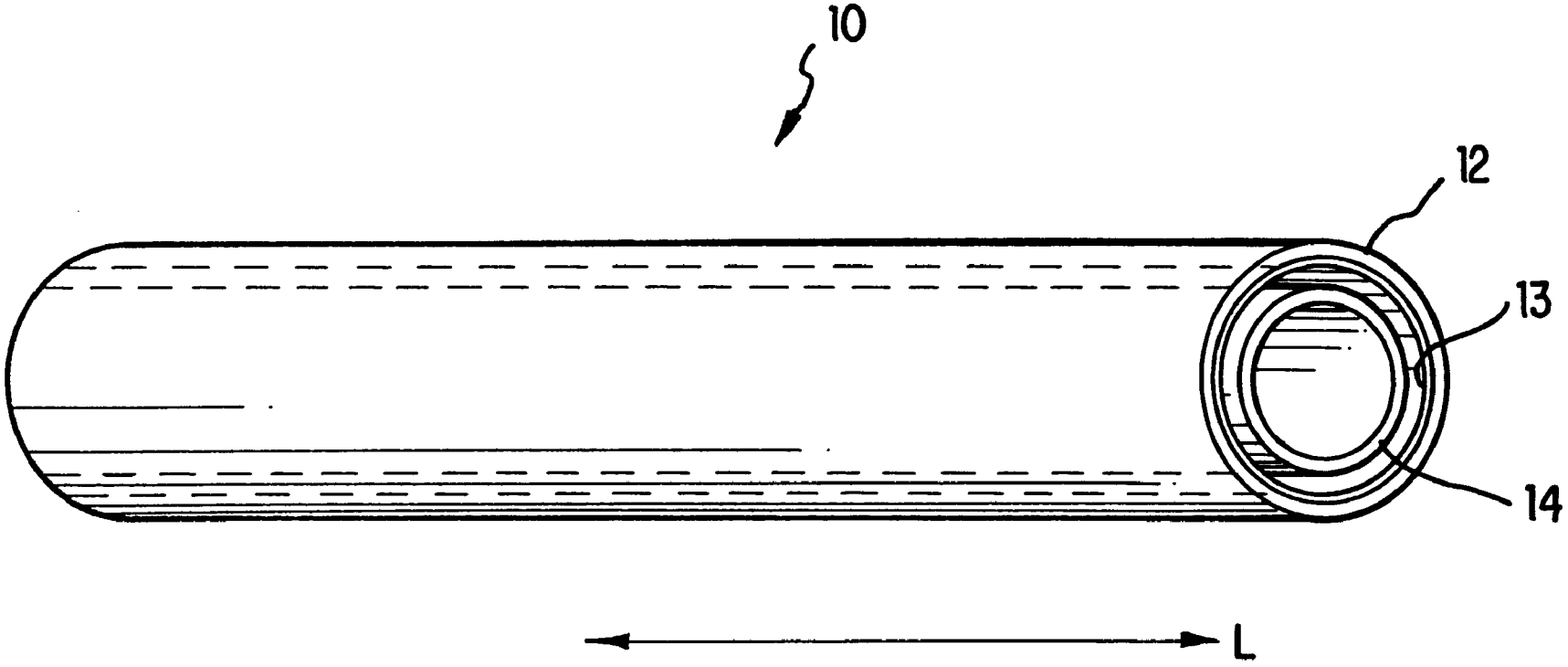
FIG. 1 is a side view of the expendable tubing conveyed perforator of the invention.

FIG. 1 shows the expendable tubing conveyed perforator 10 of the invention. According to the invention, the outer tube 12 of the expendable tubing conveyed perforator is made from a material having high strength and low impact resistance. As defined herein, the phrase "high strength and low impact resistance" refers to those materials having tensile strengths in the range from approximately 200 to approximately 1000 ksi, moduli from approximately 20 to approximately 150 Msi, and elongations from approximately 0.2 to approximately 3%, all parameters being measured at room temperature. Examples of such materials are carbon fibers, glass fibers, or combinations thereof.

Preferable carbon fibers that are useful in preparing the outer tube portion of the invention include polyacrylonitrile-(PAN) or pitch-based carbon fibers. As indicated above, these carbon fibers preferably have tensile strengths in the range from approximately 200 to approximately 1000 ksi, moduli from approximately 20 to approximately 150 Msi, and elongations from approximately 0.2 to approximately 3%, all parameters being measured at room temperature. Suitable carbon fibers meeting these parameters are available commercially from Toray (Encino, Calif.), Toho (Huntsville, N.C.), Hexcel (Arlington, Tex.), and Amoco (Greenville, S.C.).

Glass fibers that are useful according to the invention include E or S-glass fibers and/or cloths with tensile strengths ranging from about 500 ksi to 650 ksi and moduli ranging from about 10 Msi to 13 Msi.

Preferably, the carbon or glass fibers that make up the outer tube of the TCP of the invention are molded in an embrittled resin (i.e., a matrix material lacking fracture toughness so as to enhance the composite's frangibility.) Generally, embrittled resins result from material choice, cure characteristics, or combinations of these, and are known to those skilled in the art. Useful resins include thermosets (e.g., epoxies, polyesters, or phenolics), or thermoplastics (e.g., polyimide or polystyrene). Metal or ceramic matrices could also be used. Regardless of the choice of resin, the outer tube should be highly frangible by the explosive force in the explosives commonly used in tubing-conveyed perforators, such as RDX, HMX, HNS, and PYX.

The outer tube 12 of the expendable TCP of the invention may be made by conventional manufacturing processes known in the art for processing carbon or glass fibers into useful articles. Exemplary manufacturing methods include filament winding, hand lay-up, autoclave, compression molding, thermoplastic molding, resin transfer molding, structural reaction injection molding, fiber placement, tape placement, braiding, or combinations of these methods.

The thickness of the outer tube 12 is preferably thin enough such that the tube fragments into small pieces upon detonation, yet thick enough to provide structural integrity and protection to the inner structure. Preferably, the outer tube possesses sufficient axial tensile strength necessary to support the vertical combined weight of the system when situated in the well hole. The outer tube preferably also possesses sufficient axial compression strength required to move the TCP unit around bends or maintain a nonvertical position. It will be appreciated that the thickness of the outer tube will vary depending on parameters such as the types of carbon fibers used, the type of resin used, and the specific application and result required. These parameters are well-known to those skilled in the art.

Preferably, the thickness of the outer tube is from about 0.05 to about 0.75 inch, and more preferably from about 0.1 to about 0.5 inch. A preferred thickness for the outer tube is about 0.33 inch. The outer tube portion 12 of the present invention should also be able to withstand the environmental conditions encountered in a well hole at 1,000–40,000 feet. Generally, these conditions include temperatures in the range of about 200° F. to about 350° F., pressures in the range of about 6,000 to 20,000 psi, and exposure to corrosive and/or noxious chemicals such as hydrogen sulfide, calcium hydroxide, and carbon dioxide.

The frangible nature of the materials used to construct the outer tube results in high fragmentation of the outer tube upon detonation of the explosive charges. Preferably, the outer tube is fragmented into pieces less than about 4 inches, more preferably less than about 1 inch, and most preferably less than about 0.1 inches.

Figure 2:
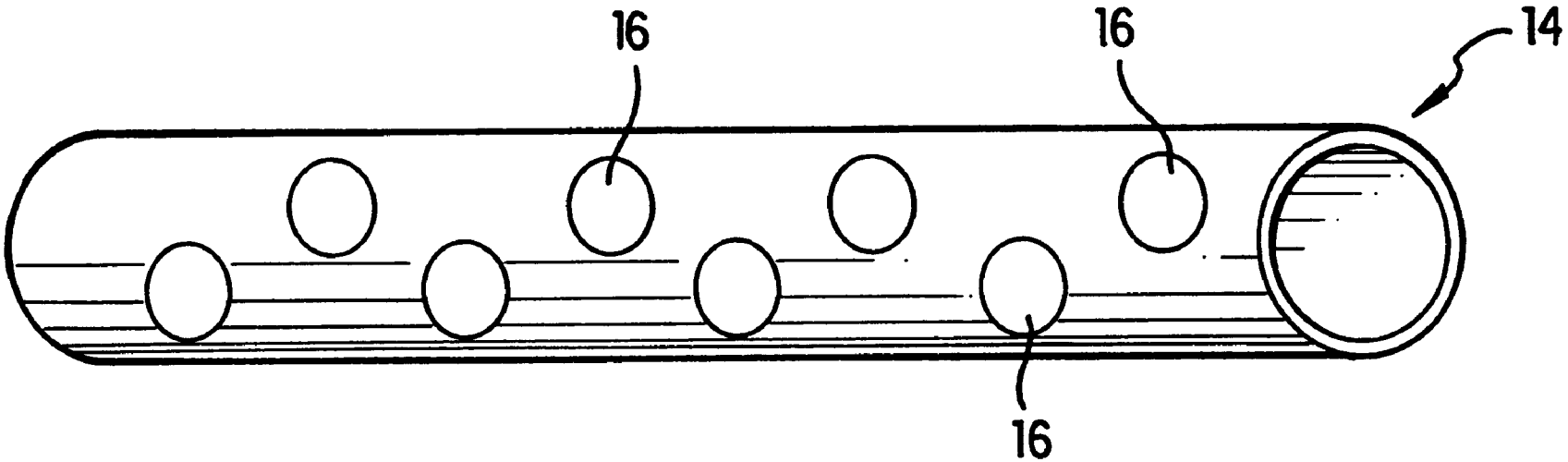
FIG. 2 is a side view of the inner structure of the expendable tubing conveyed perforator of the invention.
Figure 3:
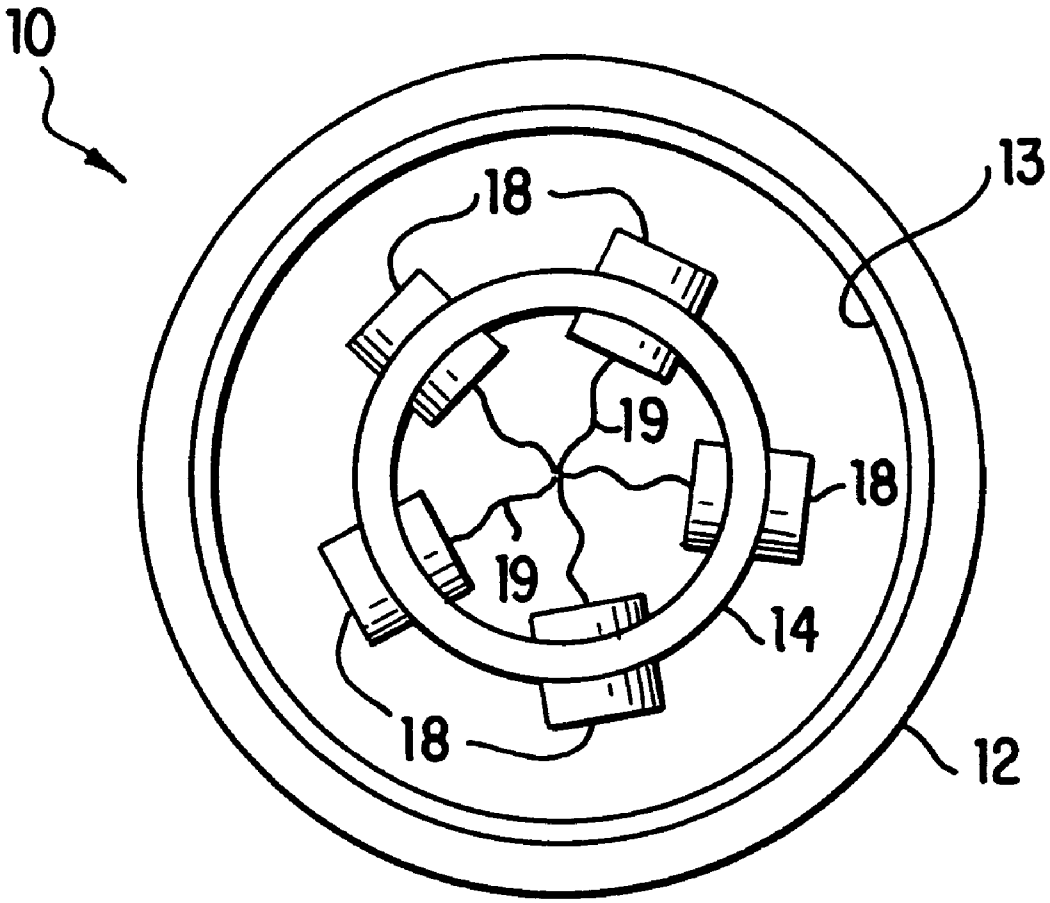
FIG. 3 is an end view of the expendable tubing conveyed perforator of the invention.

According to the invention, the inner structure 14 is positioned within the outer tube and preferably parallel to the longitudinal axis L of the outer tube 12 as shown in FIG. 1. As shown in FIGS. 2 and 3, the inner structure 14 is preferably tubular with holes 16 that can accommodate the shaped explosive charges 18. Generally, shaped charges that are useful in the expendable TCP of the invention are well known in the art and are available commercially. As shown in FIG. 3, the shaped charges 18 are connected by primer cords 19 so that they may be simultaneously detonated.

The inner structure 14 of the invention is made from a combustible structural material such as nitrocellulose, wood cellulose, cardboard, fiberboard, thermoplastic, thermoset resin, thin gauge metals, structural foam, and the like. The materials used to manufacture the inner structure 14 are combustible upon detonation of the explosive charges, and following detonation, the material that makes up the inner structure is substantially combustibly consumed, leaving only ash and minor residue.

An optional tubular layer of disintegration-enhancing material 13 may be positioned within the outer tube 12 and parallel to the longitudinal axis L of the outer tube 12 as shown in FIGS. 1 and 3. The tubular layer of disintegration enhancing material 13 is positioned within the annular space between the outer surface of the inner structure 14 and the inner surface of the outer tube 12, and preferably just adjacent to the inner surface of the outer tube 12. The disintegration-enhancing material 13 is preferably made from a combustible material such as nitrocellulose, wood cellulose, cardboard, fiberboard, thermoplastic, thermoset resin, foam, paint, and the like. The disintegration-enhancing material 13 is combustible upon detonation of the explosive charges, and following detonation is substantially combustibly consumed, leaving only ash and minor residue.

Unlike the inner structure 14, the optional disintegration-enhancing material 13 is not required to possess extensive structural capability. Upon combustion, the optional disintegration-enhancing material 13 provides additional energy to aid in disintegrating frangible outer tube 12 into small pieces.

Figure 4:
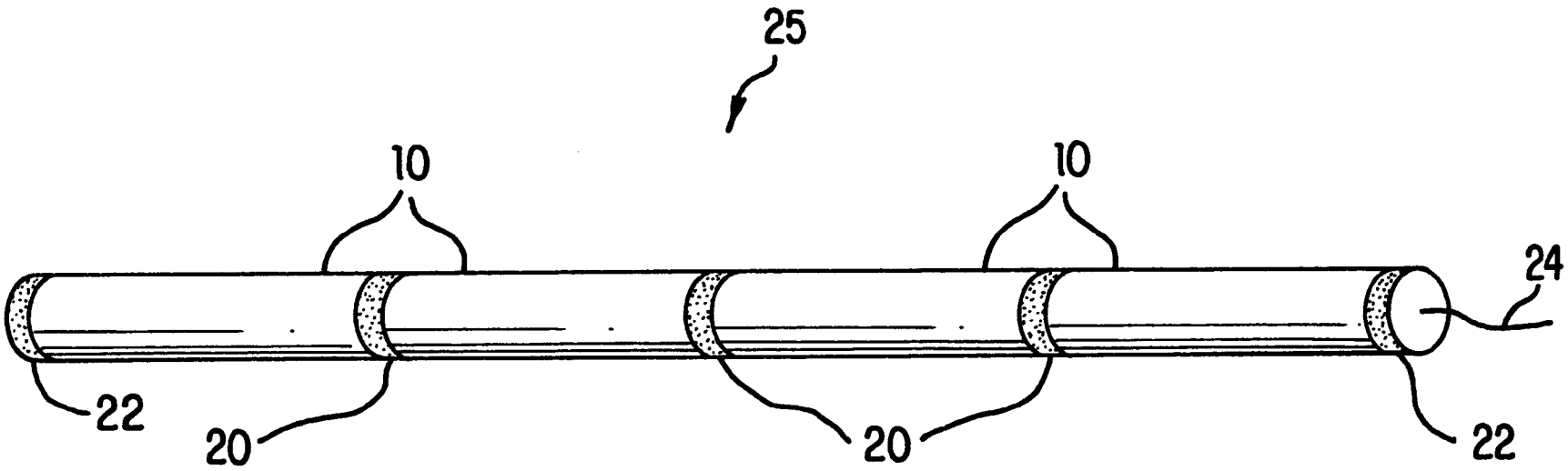
FIG. 4 is a side view of an alternative embodiment of the expendable tubing conveyed perforator of the invention.

The expendable tubing conveyed perforator 10 of the invention may be combined in sections to produce a longer perforator unit 25 as shown in FIG. 4. As shown in FIG. 4, each perforator 10 is connected to the next perforator by a connector 20 and held in place with an adhesive, such as an epoxy adhesive, or threaded interface, pins, integrated entrapment, or a combination of these attaching means. The connectors 20 may be made from materials such as steel, or the same frangible materials as the outer tube 12 so that the connectors are also highly fragmented upon detonation. End plugs 22 are used to cap the ends of the perforator unit 25 and are also held in place with an adhesive, threaded interface, pins, integrated entrapment, or a combination of these. Like the connectors 20, the end plugs 22 may also be made from steel or the same frangible materials used to make the outer tube 12. The primer cord 24 for the perforator unit 25 extends out the top of one of the end plugs 22 and may be connected to conventional detonating equipment known in the art.

In use, the expendable tubing conveyed perforator is lowered into the well casing to the desired depth and detonated using conventional procedures. The frangible nature of the materials of the outer tube fragment upon detonation into a multitude of small pieces, preferably less than about 3 inches in size. Concomitantly, the combustible material that makes up the inner structure is substantially combustibly consumed leaving only minor amounts of ash and residue. The small fragmented pieces of the outer tube either fall to the bottom of the well and, due to their small size, compact into a small volume in the "rathole" portion of the well, or pumped out of the well at a later time. Thus, shorter ratholes are required when utilizing the expendable TCP of the invention as compared with TCPs of the prior art. In addition, the small pieces of fragmented outer tube and minor residue generated from combustion of the inner structure substantially reduce the chance of clogging the well or oil extracting equipment. Thus, the present invention and the method of using it eliminates post-fire perforator gun removal by extraction or discarding into a rathole.

EXAMPLE

The invention is further described by the following Example. All parts and percentages are by weight and all temperatures are in degrees Fahrenheit unless explicitly stated otherwise.

The outer tube of the sample expendable tubing conveyed perforator was manufactured from Toray T700-24K carbon fiber by winding one 92.625 inch long tube and subsequently cutting it into sections. The carbon fiber tube was impregnated with an epoxy resin and hardener (D.E.R. 383 and Lindride 66K). An accelerated cure rate was employed to decrease the fracture toughness and ductility of the resulting outer tube structure. The final section of outer tubing was 36 inches long, had a 4.87 inch outer diameter, a 4.19 inch inner diameter (wall thickness of 0.34 inch), and weighed 9.06 pounds. The final tube was capable of withstanding external hydrostatic pressure of about 10,000 psi.

The inner structure of the expendable tubing conveyed perforator was fabricated from steel tubing having a wall thickness of 0.06 inches. Holes were cut in the inner structure to position shape charges at 12 shots per foot in a radial spiral pattern. Shape charges are typically held in place by bending a tine to engage a circumferential groove on each shape charge body. The weight of the inner structure was about 3.4 pounds.

The shaped charges were mounted in each of the holes in the inner structure. Thirty-three (33) perforator charges were used. Each charge contained about 22.7 grams of explosive, and the total weight of all the charges was about 14.4 pounds. The charges were connected with 80 grain per foot primer cord. The inner structure was inlaid with shape charges and inserted into the outer tube. The assembly was capped at both ends with two 14 lb. steel plugs with engagement reliefs to position the inner structure in the correct position relative to the inside wall of the outer tube. These plugs were bonded into the outer tube with epoxy adhesive. The primer cord extended out through hole in top steel plug.

The expendable tubing conveyed perforator assembly described above was inserted into a 50 inch length of 7 inch diameter steel oil well casing pipe mounted in the center of a concrete-filled culvert pipe section. The assembly was lowered into the well casing and centered using foam spacers. The assembly was fired remotely using a firing train hooked to the primer cord. Following firing, post-fire debris was gathered and examined, and perforation holes were measured.

Analysis of the post-fire debris indicated that the largest pieces of the outer tube were about 3 inches in length, 0.5 inches wide, and about 0.1 inches thick. Most of the debris from the outer tube was in the form of small, thin strands of fibrous material. Composite debris was fragmented, not spirally nested. A few pieces of the steel inner structure, averaging about 1 inch by 1.5 inch, remained.

While the invention has been described in combination with embodiments thereof, it is evident that many alternatives, modifications and variations will be apparent to those skilled in the art in light of the foregoing description. Accordingly, it is intended to embrace all such alternatives, modifications and variations as fall within the spirit and broad scope of the appended claims.

What is claimed is:

1. An expendable tubing conveyed perforator, comprising:

(a) an outer tube made from a material having high strength and low impact resistance and selected from the group consisting of carbon fibers in an embrittled resin, glass fibers in an embrittled resin, and combinations thereof; and (b) an inner structure positioned within said outer tube for holding one or more explosive charges, said inner structure made from a combustible material selected from the group consisting of nitrocellulose, wood cellulose, cardboard, fiberboard, thermoplastic, thermoset resin, thin gauge metals, structural foam, and combinations thereof.

2. The expendable tubing conveyed perforator of claim 1, wherein said carbon fibers are selected from the group consisting of polyacrylonitrile-based carbon fibers and pitch-based carbon fibers.

3. The expendable tubing conveyed perforator of claim 2, wherein said embrittled resin is selected from the group consisting of thermoset epoxies, thermoset polyesters, thermoset phenolics, thermoplastics, and combinations thereof.

4. The expendable tubing conveyed perforator of claim 1, wherein said outer tube has a wall thickness in the range of about 0.05 to about 0.75 inch.

5. The expendable tubing conveyed perforator of claim 1, wherein substantially all of said outer tube is fragmented upon detonation of said one or more explosive charges, and substantially all of said inner structure is combustibly consumed upon detonation of said one or more explosive charges.

6. The expendable tubing conveyed perforator of claim 1, further comprising a disintegration-enhancing tube positioned between said outer tube and said inner structure.

7. The expendable tubing conveyed perforator of claim 6, wherein said disintegration-enhancing tube is made from a material selected from the group consisting of nitrocellulose, wood cellulose, cardboard, fiberboard, thermoplastic, thermoset resin, structural foam, and combinations thereof.

8. The expendable tubing conveyed perforator of claim 7, wherein substantially all of said disintegration-enhancing tube is combustibly consumed upon detonation of said one or more explosive charges.

9. An expendable tubing conveyed perforator, comprising:

(a) an outer tube made from a material having high strength and low impact resistance; and (b) an inner structure positioned within said outer tube for holding one or more explosive charges, said inner structure made from a combustible material; and (c) a disintegration-enhancing tube positioned between said outer tube and said inner structure;

wherein substantially all of said outer tube is fragmented upon detonation of said one or more explosive charges, and wherein substantially all of said inner structure is combustibly consumed upon detonation of said one or more explosive charges, and wherein substantially all of said disintegration-enhancing tube is combustibly consumed upon detonation of said one or more explosive charges.

10. The expendable tubing conveyed perforator of claim 9, wherein said material having high strength and low impact resistance is selected from the group consisting of carbon fibers in an embrittled resin and glass fibers in an embrittled resin.

11. The expendable tubing conveyed perforator of claim 10, wherein said carbon fibers are selected from the group consisting of polyacrylonitrile-based carbon fibers and pitch-based carbon fibers.

12. The expendable tubing conveyed perforator of claim 11, wherein said embrittled resin is selected from the group consisting of thermoset epoxies, thermoset polyesters, thermoset phenolics, thermoplastics, and combinations thereof.

13. The expendable tubing conveyed perforator of claim 9, wherein said combustible material is selected from the group consisting of nitrocellulose, wood cellulose, cardboard, fiberboard, thermoplastic, thermoset resin, thin gauge metals, structural foam, and combinations thereof.

14. The expendable tubing conveyed perforator of claim 10, wherein said outer tube has a wall thickness in the range of about 0.05 to about 0.75 inch.

15. The expendable tubing conveyed perforator of claim 9, wherein said disintegration-enhancing tube is made from a material selected from the group consisting of nitrocellulose, wood cellulose, cardboard, fiberboard, thermoplastic, thermoset resin, structural foam, and combinations thereof.

16. A method of perforating a well casing, comprising the step of detonating an expendable tubing conveyed perforator inserted into said well casing, said tubing conveyed perforator comprising:

(a) an outer tube made from a material having high strength and low impact resistance and selected from the group consisting of carbon fibers in an embrittled resin, glass fibers in an embrittled resin, and combinations thereof; and (b) an inner structure positioned within said outer tube and holding one or more explosive charges, said inner structure made from a combustible material selected from the group consisting of nitrocellulose, wood cellulose, cardboard, fiberboard, thermoplastic, thermoset resin, thin gauge metals, structural foam, and combinations thereof; and wherein substantially all of said outer tube is fragmented upon detonation of said one or more explosive charges, and substantially all of said inner structure is combustibly consumed upon detonation of said one or more explosive charges.

17. The method of claim 16, wherein said carbon fibers are selected from the group consisting of polyacrylonitrile-based carbon fibers and pitch-based carbon fibers.

18. The method of claim 17, wherein said embrittled resin is selected from the group consisting of thermoset epoxies, thermoset polyesters, thermoset phenolics, thermoplastics, and combinations thereof.

19. The method of claim 16, wherein said outer tube has a wall thickness in the range of about 0.05 to about 0.75 inch.

20. The method of claim 16, wherein said tubing conveyed perforator further comprises a disintegration-enhancing tube positioned between said outer tube and said inner structure.

21. The method of claim 20, wherein said disintegration-enhancing tube is made from a material selected from the group consisting of nitrocellulose, wood cellulose, cardboard, fiberboard, thermoplastic, thermoset resin, structural foam, and combinations thereof.

22. The method of claim 20, wherein substantially all of said disintegration-enhancing tube is combustibly consumed upon detonation of said one or more explosive charges.

* * * * *